US005078800A

United States Patent [19]

Cahill

[11] Patent Number: 5,078,800

[45] Date of Patent: Jan. 7, 1992

[54] METHOD OF CLEANSING MATERIAL

[76] Inventor: John A. Cahill, 33-52 85th St., Apt. 600, Jackson Heights, N.Y. 11372

[21] Appl. No.: 522,184

[22] Filed: May 11, 1990

[51] Int. Cl.[5] ..... B08B 3/04

[52] U.S. Cl. ..... 134/25.3; 134/182; 134/201; 210/244; 210/464

[58] Field of Search ..... 134/25.3, 104.3, 117, 134/182, 183, 198, 201; 366/130; 99/295, 306, 536; 210/244, 464, 465, 470; 220/601, 661, 676; 137/268; 4/290, 652, 654; 222/189, 565; 209/235, 372, 417; 422/266, 274, 276, 277; 68/213; 206/0.5

[56] References Cited

U.S. PATENT DOCUMENTS

| | | | |
|---|---|---|---|
| 463,505 | 11/1891 | Glynn | 210/464 |
| 790,052 | 5/1905 | Hardie et al. | 222/189 |
| 1,460,308 | 6/1923 | Bentley | 222/189 |
| 2,185,897 | 1/1940 | Krause et al. | 210/244 |
| 2,577,200 | 12/1951 | Krause | 99/306 |
| 3,510,108 | 5/1970 | Yego, Jr. | 366/165 |
| 4,756,323 | 7/1988 | Horton | 134/117 X |

FOREIGN PATENT DOCUMENTS

| | | | |
|---|---|---|---|
| 1260342 | 3/1961 | France | 68/213 |
| 52597 | 5/1933 | Norway | 222/189 |
| 1399859 | 7/1975 | United Kingdom | 68/213 |

*Primary Examiner*—Philip R. Coe
*Attorney, Agent, or Firm*—Henry M. Feiereisen

[57] ABSTRACT

A treatment container for washing and rinsing materials includes a body with open top and a screen or mesh in proximity of the top of the body for allowing drainage of excess cleansing liquid and washed-off substances during cleansing of the material while retaining the material within the interior of the container. For complete removal of water and washed-off substances from the container after terminating washing of the material, the container may be closed by a lid and turned upside down to thereby permit the cleansing liquid to drain through the mesh which, at inverted position of the container, extends at the bottom of the body.

1 Claim, 3 Drawing Sheets

METHOD OF CLEANSING MATERIAL

BACKGROUND OF THE INVENTION

The present invention generally refers to a container for treating materials, and more particularly to a container for soaking, washing and rinsing and possibly cooking foodstuff such as for example rice, beans, berries etc.

U.S. Pat. No. 3,510,108 describes a rice washer which includes a cylindrical container with a lid divided into three parts by suitable dividers. Two parts are held snugly in place on the cylindrical wall by a pressure fit while the third part is hinged to permit opening and closing of the container, with each part of the lid being covered by a suitable screening. Water is introduced through a central opening of the lid. After circulation through the container, the water flows out through the screening, with washed-off substances being carried therewith. Rice is removed from the container through the hinged part. A rice rinser of this type is complicated because it requires a specially designed lid portion and inconvenient because hinged part provides only limited space for removal of rice.

U.S. Pat. No. 4,756,323 discloses a rice washer which includes a screen mesh container retained within a cylinder for holding rice while the cylinder is partially filled with water. The cylinder is closed at its opposing ends by threadably attached lids. By unscrewing the bottom lid, water can be removed without losing rice while the mesh with rice is withdrawn through the top opening after unscrewing the top lid. A rice washer of this type is not only complicated but also inconvenient because drainage of water through the bottom opening requires the user to lift the rice rinser with one hand and to unscrew the bottom lid, whereby water will be splashed over the hand of the user.

SUMMARY OF THE INVENTION

It is a general object of the present invention to provide an improved treatment container for cleansing articles or materials such as foodstuff obviating the afore-stated drawbacks.

Another object of the present invention is to provide an improved treatment container for washing and rinsing materials in an economical and yet convenient manner.

Yet another object of the present invention is to provide a multi-purpose container for allowing washing, rinsing and cooking of foodstuff.

These objects and others which will become apparent hereinafter are attained in accordance with the present invention by providing a container with a mesh extending about a circumferential area in vicinity of the open top of the container so that water or any other suitable cleansing liquid can flow through the open top into the container for washing and rinsing the material such as foodstuff while excess water and washed off substances can drain through the mesh without carrying foodstuff therewith.

A container in accordance with the present invention allows foodstuff such as rice, beans, berries etc. to be easily charged into the interior of the container and washed by placing the container under running water while foodstuff is prevented by the mesh from being unintentionally discharged from the container.

In accordance with a further feature of the present invention, the container is provided with a lid by which then open top can be tightly sealed for removing the water after completing the washing step. After attaching the lid, the container can be inverted so that the mesh is now at the bottom area and permits all water to be drained. Preferably, the container is provided with a threaded portion which mates with a complementary threaded portion of the lid to attain a tight sealing of the open top portion. Alternatively, a snap-on lid or any other firmly attachable lid may be usable.

According to a further embodiment of the present invention, the container may include a spout with the mesh arranged at the junction of the interior of the container into the spout so that water and washed-off substances may be discharged through the spout while foodstuff is retained within the container. For example, by making a container of this type from metal or suitably tempered glass, the container may be used also for heating up and cooking the foodstuff. In this case, the container is provided with a suitable handle so that hot water can be discharged through the spout by simply tilting the container. Preferably, during cooking procedures of foodstuff, the top of the container is closed by the lid which simply rests on an internal annular shoulder of the container, and the open mouth of the spout is closed by a suitable plug.

In order to allow use of a same container with a variety of screens having different perforation, according to yet another embodiment, the container is provided in its wall with an opening in which a selected screen is detachably secured. Preferably, the top edge of the container is provided with a longitudinal slot in communication with the opening so that a suitable screen can be slid in and out from the opening.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
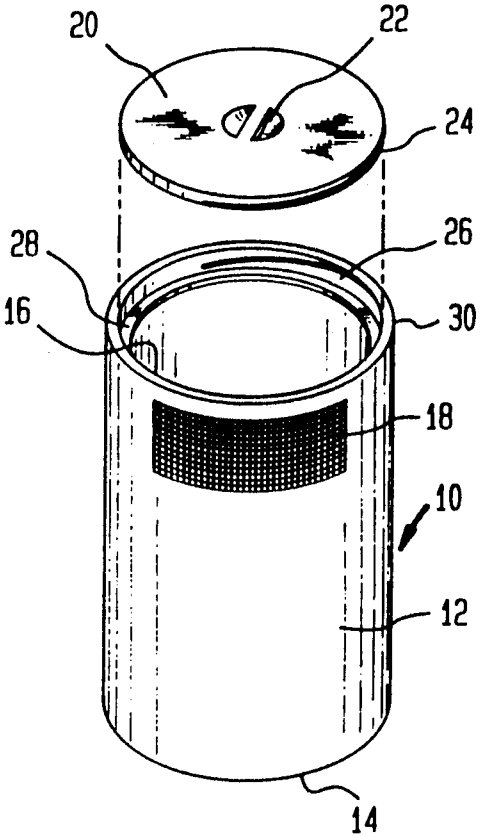
FIG. 1 is a perspective view, in exploded illustration, of a first embodiment of a container in accordance with the present invention.

Referring now to the drawing, and in particular to FIG. 1, there is shown a perspective view, in exploded illustration, of a first embodiment of a container in accordance with the present invention and generally designated by reference numeral 10. The container 10 includes a generally cylindrical body or wall 12 with closed bottom 14 and open top 16. The body 12 of the container 10 may be made of any suitable material such as plastic material, metal etc. As shown by way of example in FIG. 2, the body 12 of the container 10 is made of plastic material.

In immediate proximity of the top 16, the body 12 is provided with an integral screen or mesh 18 which extends about a circumferential area of the body 12. The perforations of the mesh 18 are selected in such a manner that foodstuff to be washed or rinsed within the container 10 is withheld from passing through when excess water flows through the mesh 18. It will be understood that the mesh 18 as illustrated in FIG. 1 is made only by way of example and that the container 10 may certainly be provided about the circumference of the body 12 with more than one such meshes or screens which can be of any suitable dimension.

When desiring to cleanse foodstuff such as rice, beans or the like, the container 10 with the foodstuff is placed with open top 16 under running water, for example under a faucet (not shown). The water washes the foodstuff while circulating into the container 10 and exiting through the mesh 18, with the foodstuff being retained inside the container 10. Washed-off substances such as for example rice starch are carried with the water through the mesh 18 and discharged. As has been set forth, the perforations of the mesh 18 are of such size as to prevent the foodstuff from being carried out of the container by the outflowing water while allowing washed-off substances to pass therethrough. Rinsing of the foodstuff can certainly be enhanced by suitably stirring the foodstuff. In this context, it should be understood that throughout the description the terms, soaking, washing and rinsing are considered equivalent in describing the nature of cleansing the foodstuff or material within the container.

Figure 2:
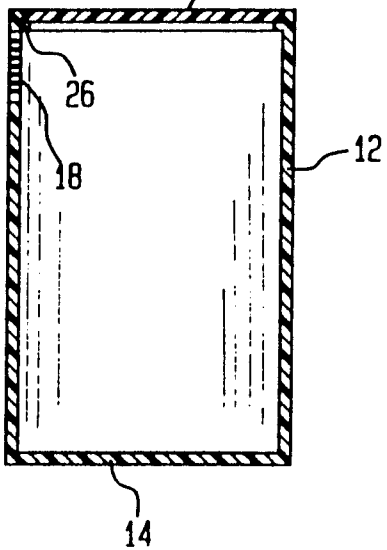
FIG. 2 is a sectional view of the container of FIG. 1.

As further shown in FIG. 1, the top 16 of the container 10 is closable by a lid 20 which is provided with a flush countersunk handle 22 and has an external thread 24 designed to mate with an internal thread 26 surrounding the top 16 of the container 10. Extending slightly above the mesh 18, the container 10 is provided with an inner annular shoulder 28 against which the lid 20 abuts when being threadably engaged to the container 10 (FIG. 2). The distance of the shoulder 28 to the top edge 30 of the container 10 is selected to ensure the outside surface of the lid 20 to be flush with the top edge 30 of the container 10. It will be readily recognized that the lid 20 may be attached to the container 10 also by other means which ensure a tight connection of the lid 20 with the container 10, such as e.g. a snap-on connection.

Figure 3:
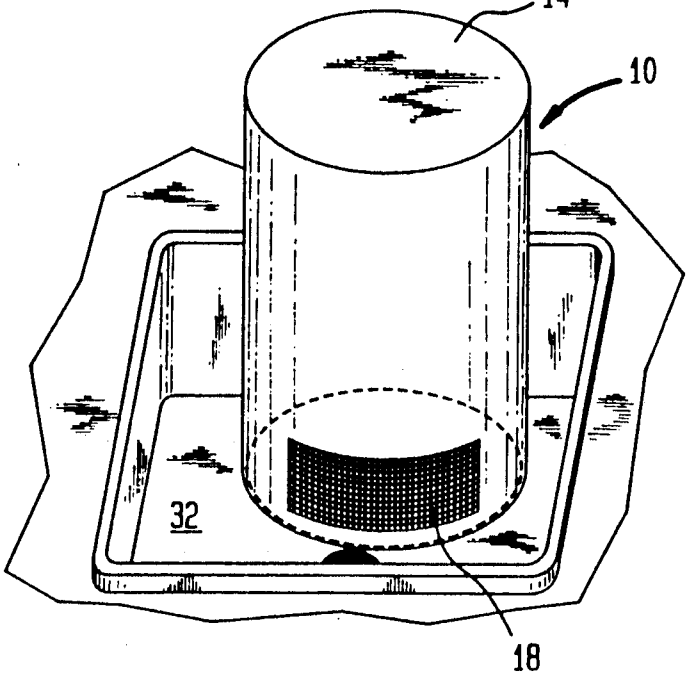
FIG. 3 is a perspective view of the container of FIG. 1 in inverted position and placed in an exemplified sink for drainage of water.

After cleansing the foodstuff, the top 16 of the container 10 is tightly sealed by the lid 20 and the container 10 is placed upside down for example in a sink 32 as shown in FIG. 3. By inverting the container 10, the mesh 18 now extends near the bottom area so that water is completely drained from the interior while the foodstuff is withheld from exiting. As the mesh 18 extends up to the shoulder 28 for the lid 20, water can be completely drained from the interior of the container 10.

After drainage of water, the container 10 is inverted again, and the lid 20 is removed by turning the handle 22 to open the top 16 and to allow removal of the foodstuff.

Figure 5:
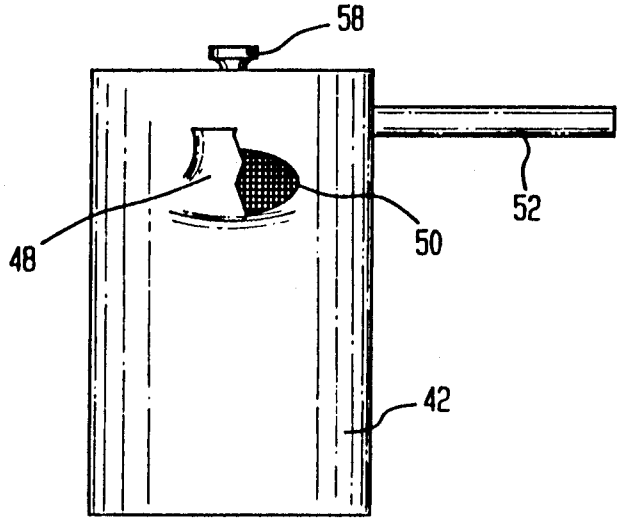
FIG. 5 is a side view of the container of FIG. 4 with partially broken away spout for illustration of a mesh portion.
Figure 7:
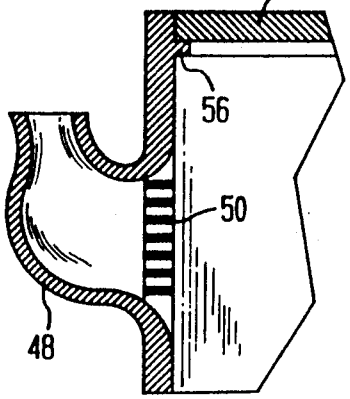
FIG. 7 is a detailed sectional illustration of the area surrounding the spout of the container.
Figure 4:
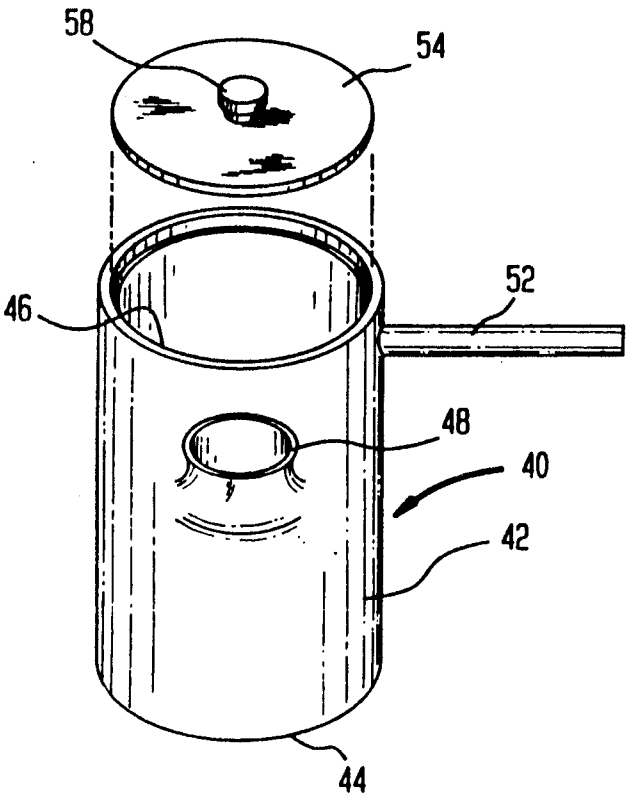
FIG. 4 is a perspective view, in exploded illustration, of a second embodiment of a container in accordance with the present invention.

Turning now to FIG. 4, there is shown a perspective view, in exploded illustration, of a second embodiment of a container in accordance with the present invention and generally designated by reference numeral 40. In contrast to the previously described container 10, the container 40 may also be used for heating up or cooking the foodstuff. The container 40 includes a generally cylindrical body or wall 42 with closed bottom 44 and open top 46. The body 42 of the container 40 is made of material suitable for cooking purposes such as for example metal. At a suitable location, the body 42 is provided with a spout 48 which may form an integral part of the body 42 or may be a separate piece suitably attached to the body 42. As shown in particular in FIGS. 5 and 7, at the junction from the interior of the container 40 into the spout 48, a mesh 50 is provided with perforations dimensioned in such a manner that foodstuff to be washed or rinsed within the container 10 is withheld from passing therethrough while excess water can easily be drained.

When washing or rinsing foodstuff, the container 40 is placed with open top 46 under running water, for example under a faucet (not shown) so that the water washes the foodstuff while circulating into the container 40 and exiting with washed-off substances through the spout 48, with the foodstuff being retained inside the container 40 by the mesh 50.

As previously set forth, the spout 48 is positioned at the body 42 at a level so as to prevent water from overflowing and thus to prevent foodstuff from being discharged through the top 46 during the washing procedure. Also, it will be readily recognized that the outlet opening of the spout 48 is of such dimension as to prevent banking up of the water level inside the container 40 in order to avoid overflow through the top 46.

In vicinity of its top 46, the container 40 is provided with a handle 52 which is suitably mounted to the body 42. By tilting the container 40 via the handle 52, water can be completely removed from the interior of the container 40.

Figure 6:
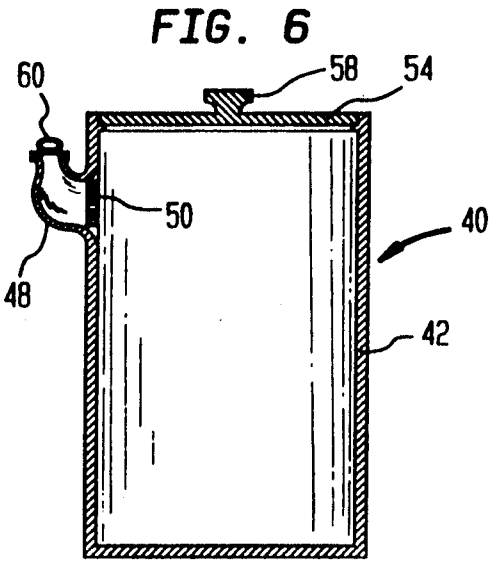
FIG. 6 is a sectional view of the container of FIG. 4, with plugged spout.

As further shown in FIG. 4, the open top 46 of the container 40 is closable by a lid 54 which rests on an inner annular shoulder 56 of the body 42 and includes an external central knob 58 for easy attachment and removal of the lid 54. In the event the container 40 is used for cooking purposes after effecting washing of the foodstuff and drainage of water, the container 40 is placed for example on a stove and closed by the lid 54. In addition, the mouth opening of the spout 48 should also be closed e.g. by a suitable plug 60 as illustrated in FIG. 6. After cooking, any liquids can be discharged through the spout 48 by tilting the container 40, with the mesh 50 retaining the foodstuff inside the container 40.

Figure 8:
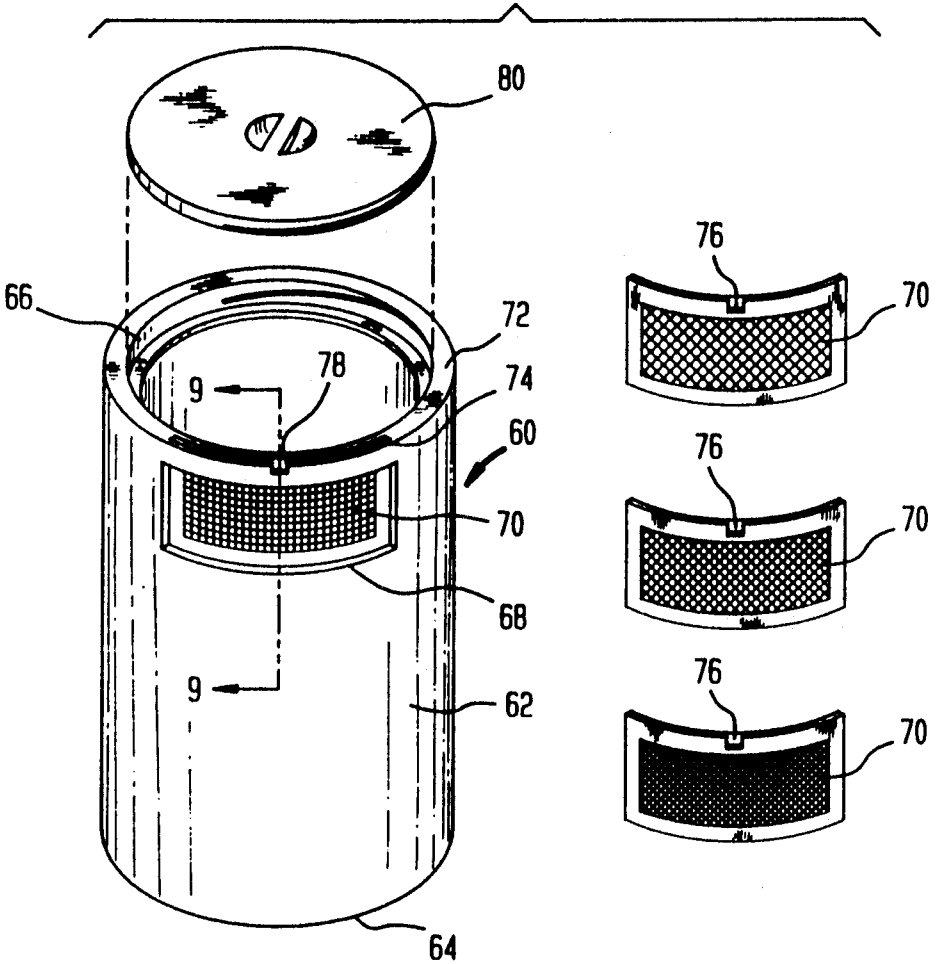
FIG. 8 is a perspective view, in exploded illustration, of a modification of the container of FIG. 1, illustrating various designs of exchangeable screens for use in the container.

Turning now to FIG. 8, there is shown a perspective view, in exploded illustration, of a further embodiment of a container in accordance with the present invention and generally designated by reference numeral 60. The container 60 is essentially of the same type as the container 10 as illustrated in FIG. 1 except that the container 60 is adapted for use of a variety of interchangeable screens of varying perforation in order to permit use of the container 60 for differently sized foodstuff or materials or articles treated therein.

The container 60 includes a generally cylindrical body or wall 62 with closed bottom 64 and open top 66.

The body 62 of the container 60 may be made of any suitable material such as plastic material, metal etc. In immediate proximity of the top 66, the body 62 is provided with a rectangular opening 68 which extends about a circumferential area of the body 62 and accommodates an exchangeable screen or mesh 70 curved in accordance with the contour of the body 62. The perforations of the screen 70 are selected in such a manner that foodstuff to be washed or rinsed within the container 60 is withheld from passing through when excess water and washed-off substances flow through the screen 70.

Figure 9:
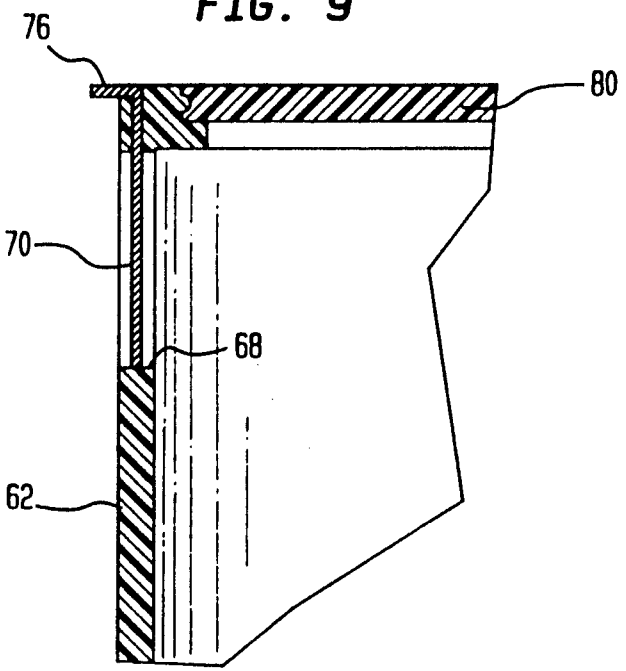
FIG. 9 is a sectional view of the container of FIG. 8 taken along the line 9—9.

Provided in the top edge 72 of the container 60 is a longitudinal slot 74 which extends to the opening 68 in order to allow exchange of one screen 70 with another. FIG. 8 shows three examples of screens 70 with varying perforations. As best shown in FIG. 9 which illustrates a cross sectional view of the container 60 taken along the line 9—9, each screen 70 is provided at its top edge with a jutting central tab 76 to serve as handle or grip during attachment and removal of the screen 70 to and from the opening 68 of the container 60. Suitably, the tab 76 projects perpendicular from the screen 70 and rests in a complementary recess 78 of the container 60 when sliding the screen 70 into the opening 68. Although not shown in detail, suitable guide rails may be provided along the inside wall of the opening 68 to facilitate attachment and removal of the screen 70.

The container 60 is used in a same manner as described in connection with the container 10. After selecting the appropriate screen 70 and sliding it through the slot 78 into the opening 68, the container 60 is placed e.g. under running water for cleansing the contained foodstuff. Subsequently, the container 60 is closed by a lid 80 and turned upside down to allow all water and washed-off substances to flow out of the container 60 through the screen 70 while the cleansed foodstuff is retained inside. The screen 70 fits snugly in slot 74 and is thus held in place by friction when inverting the container 60.

It will be understood that FIGS. 8 and 9 illustrate only one example of a container which interchangeable screens and thus should not be limited thereto. For example, instead of sliding the screen into the opening of the container 60, a snap-in attachment of the screens is certainly also feasible and should be considered within the scope of the invention.

Although not shown and described in detail, the container 40 as shown in FIGS. 4–7 may certainly be modified so as to be usable with interchangeable screens. In this case, as the screen is provided at greater distance from the top edge of the container, the tab is not directly mounted to the screen as shown in FIG. 8 but via a rod of suitable length to compensate for the distance between the screen and the top edge of the container.

It will be understood that the preceding description is made only by way of example and should not be limited to the use for treating foodstuff; rather a container according to the present invention may also be applied for cleansing articles other than foodstuff, such as for example cleansing small machine parts in a suitable solvent.

While the invention has been illustrated and described as embodied in a treatment container, it is not intended to be limited to the details shown since various modifications and structural changes may be made without departing in any way from the spirit of the present invention.

What is claimed as new and desired to be protected by Letters Patent is set forth in the appended claims.

I claim:

1. A method of cleansing material; comprising the steps of:

introducing a cleansing liquid into a container having an open top for washing the material within the container by allowing the liquid to continuously flow through the open top into the container and to exit to the outside of the container via a screening element;

tightly closing the top of the container; and inverting the container for allowing complete removal of the cleansing liquid and washed-off substances through the screening element, with the material being retained inside the container.

* * * * *